United States Patent [19]

Joshi et al.

[11] 4,351,740

[45] * Sep. 28, 1982

[54] BOTTLED PARTICULATE DETERGENT

[75] Inventors: David Joshi, Piscataway, N.J.; Richard Klingaman, Houston, Tex.

[73] Assignee: Colgate Palmolive Company, New York, N.Y.

[ * ] Notice: The portion of the term of this patent subsequent to May 26, 1998, has been disclaimed.

[21] Appl. No.: 171,325

[22] Filed: Jul. 23, 1980

Related U.S. Application Data

[63] Continuation of Ser. No. 964,037, Dec. 21, 1979, Pat. No. 4,269,722.

[51] Int. Cl.[3] ..... B65B 1/06; C11D 17/06

[52] U.S. Cl. ..... 252/90; D9/376; D9/381; 141/1; 141/18; 215/1 C; 252/135; 252/174; 252/174.13; 252/DIG. 1; 252/DIG. 12

[58] Field of Search ..... D9/39–43, D9/376, 378, 381; 215/1 C; 252/89 R, 89 B, 90, 99, 109, 135, 174, 176, DIG. 1, DIG. 12, 89.1, 174.13; 141/1, 18; 222/572

[56] References Cited

U.S. PATENT DOCUMENTS

| | | | |
|---|---|---|---|
| D. 213,822 | 4/1969 | Weckman | D9/42 |
| D. 216,583 | 2/1970 | Coghill | D9/42 |
| D. 223,601 | 5/1972 | Johnson | D9/42 |
| 3,148,804 | 9/1964 | James . | |
| 3,177,147 | 4/1965 | Dugan | 252/99 |
| 3,209,961 | 10/1965 | Wassell . | |
| 3,454,499 | 7/1969 | Meyer | 252/109 |
| 3,538,004 | 11/1970 | Gabler | 252/99 |
| 3,838,072 | 9/1974 | Smith | 252/540 |
| 3,926,827 | 12/1975 | Mangeli | 252/99 |

FOREIGN PATENT DOCUMENTS

| | | | |
|---|---|---|---|
| D. 1335 | 4/1975 | South Africa | D9/42 |

*Primary Examiner*—Bruce H. Hess

[57] ABSTRACT

A bottled particulate detergent is of certain particle sizes, bulk density and flowability and is contained in a necked bottle in which the neck opening is sufficiently small as to allow ready sealing with screw caps conventionally employed to close bottles while also allowing pouring from the bottle of the particulate detergent of the described characteristics. The bottle also includes a relatively narrow, hollow handle section through which the particulate detergent will flow. Also disclosed is a method of easily filling such bottles with free flowing particulate detergent. In both dispensing and filling operations, due to the characteristic of the detergent composition and the bottle, flow surprisingly like that of a liquid is obtained.

10 Claims, 8 Drawing Figures

1/200"

1/2000"

BOTTLED PARTICULATE DETERGENT

This is a continuation of application Ser. No. 964,037 filed Dec. 21, 1979 and contains subject matter divided out of said application now U.S. Pat. No. 4,269,722.

This invention relates to a new, strikingly different dispensing package of heavy duty detergent composition. More particularly, it relates to a bottled particulate heavy duty detergent, the particles of which may be readily dispensed like a liquid but which product is without various disadvantages associated with liquids.

Particulate detergent compositions based on synthetic organic detergents and builder salts to improve the detergency thereof are well known and have been marketed for many years. In a preferred form, such particles are rounded and may be globular or may be aggregates of small numbers of globular particles, such as those which result from spray drying of a crutcher mix of the various components thereof and subsequent screening to size. Post-spraying of liquid materials, especially heat-sensitive materials, onto the surfaces of spray dried beads in also known. However, it is often difficult to obtain a free-flowing product containing a substantial proportion of a liquid or tacky synthetic organic detergent, such as a liquid nonionic detergent, and water soluble inorganic builder salt(s). Consequently, synthetic organic detergents of lesser tackiness, such as the synthetic organic anionic detergent salts, like sodium linear tridecyl benzene sulfonate, which also contribute excellent detergency to built detergent compositions, have been used extensively. For convenience in dispensing, among other reasons, liquid detergents have been marketed, often in plastic bottles, such as those with an integrally blow-molded hollow handle. However, these liquid detergents are subject to certain disadvantages, such as the separation of various components into different phases, requiring the presence of detersively nonfunctional ingredients, such as hydrotropes, to prevent this undesirable action. The bottled particulate detergent of this invention is not subject to separation into different phases. Furthermore, because the particulate product is substantially dry, aqueous or liquid phase decomposition reactions between the components thereof do not occur and incorporation of particular stabilizers or the modifications of formulas to avoid materials which tend to react in an aqueous medium are obviated. Additionally, due to the pouring out of the particulate built detergent as a composition of solid particles the detergent gels or cement-like deposits sometimes noted on the necks of dispensing bottles for liquids do not result. In short then, the present invention allows one to obtain the various advantages of particulate or powdered detergents with packaging and dispensing conveniences equal to or better than those associated with bottled liquid detergents.

In accordance with the present invention a bottled particulate detergent comprises a bottle having a neck thereon for dispensing detergent from the bottle, and a free flowing particulate detergent composition in said bottle, having a flowability sufficiently high that said detergent flows freely through the neck of the bottle, the particles of which comprise synthetic organic detergent and builder for said detergent, are of particle sizes such that at least 90% thereof passes through an 8 mesh screen and is retained on a 200 mesh screen (U.S. Sieve Series), are of a bulk density of at least 0.5 g./cc. and are of a flowability at least 70% of that of clean dry sand. In various preferred embodiments of the invention the cross-sectional area of the passage through the bottle neck is in a particular range and within a certain range of proportions with respect to the bottle cross-sectional area; the bottle includes a hollow handle integral with it, communicating with the main bottle volume and of certain dimensions; the bottle neck is circular and is capped by a screw cap of particular size so as to serve as a convenient measuring cap for the particular detergent being dispensed; the detergent particles are dust-free; and the detergent composition is of a certain type, with the particular properties mentioned being in certain more limited ranges. Also within the invention is a simple method for filling the described bottles and the integral hollow handles thereof.

The invention will be readily understood by reference to the description in this specification, taken in conjunction with the drawing in which.

Figure 1:
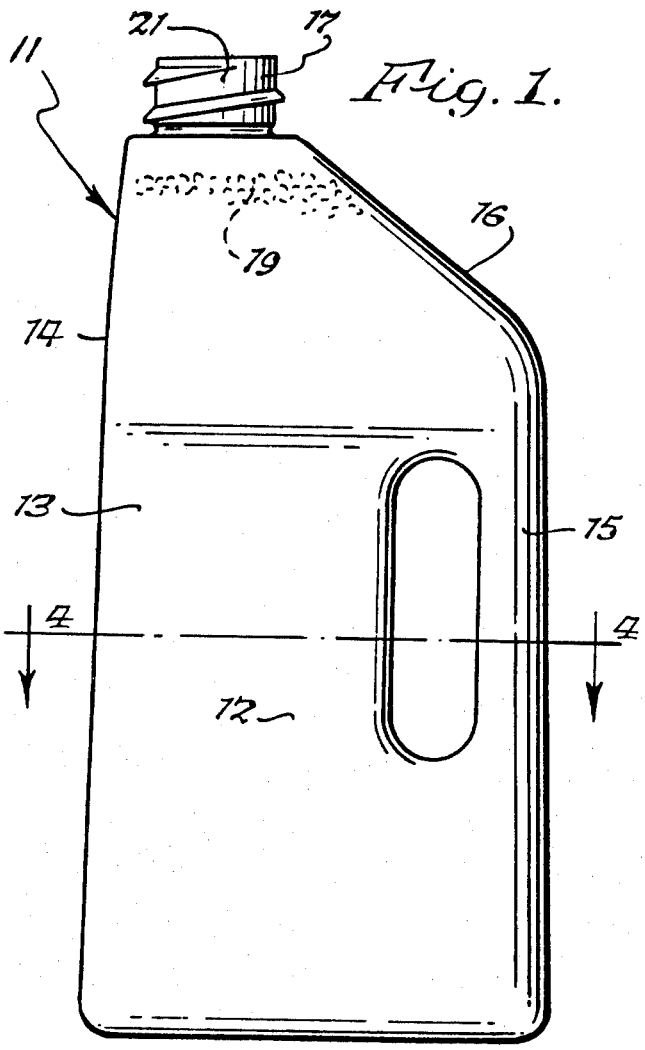
FIG. 1 is a side elevational view of a bottled (but uncapped) particulate detergent product of the invention.
Figure 3:
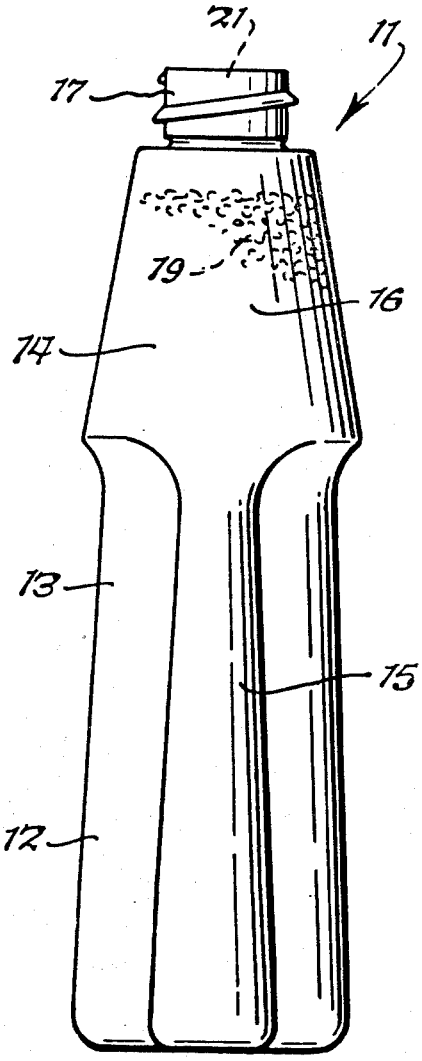
FIG. 3 is a side elevational view of said product, from the handle side.
Figure 2:
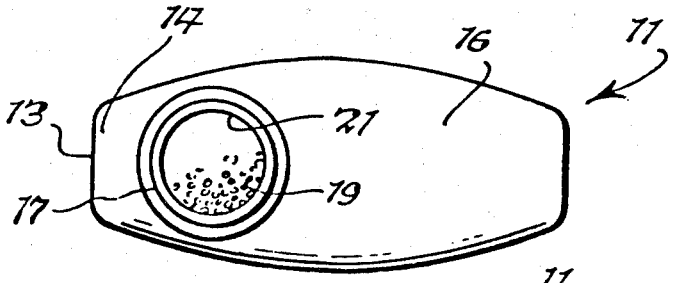
FIG. 2 is a top plan view of said product.

In FIG. 1 bottle 11, of transparent polyvinyl chloride plastic, includes a body portion 13, having a handle 15 integrally blow molded with it, and a neck portion 17. While the bottle may be of various shapes, the preferred structure shown is substantially oval in general cross-section, at least in the upper and lower portions thereof and has the neck or pour spout section at the top of the bottle and nearer to one end of the major horizontal axis of such oval, with the handle being at or near the opposite end of said axis. Also, it is preferred that upper portion 14 of body wall 12, the portion nearer to the dispensing neck end, should be nearly vertical, i.e., about 70° to 90° from the horizontal, and upper portion 16, nearer to the handle end (both neck and handle being at ends of the bottle major or long horizontal axis) should be less vertical, i.e., 30° to 60°, for reasons which will be given later. Inside bottle 11 are detergent composition particles 19, which are readily dispensable through passageway 21 in the bottle neck by merely tipping the bottle and pouring the particulate material out therefrom. The mentioned described parts are also shown in FIG'S. 2 and 3, where appropriate.

Figure 4:
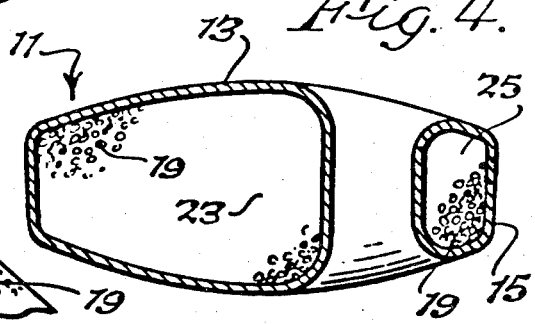
FIG. 4 is a sectional plan view along plane 4—4 of FIG. 1.

In FIG. 4 a portion of the main volume 23 of the bottle is illustrated, as is a part of the interior passageway 25 through handle 15. As shown, both are filled with particulate detergent 19.

Figure 5:
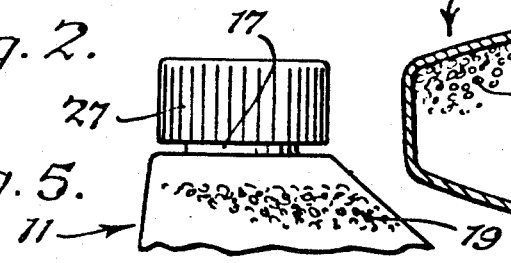
FIG. 5 is a partial side elevational view of a part of the top of the product of FIG'S. 1–4 with a sealing cap therein.
Figure 6:
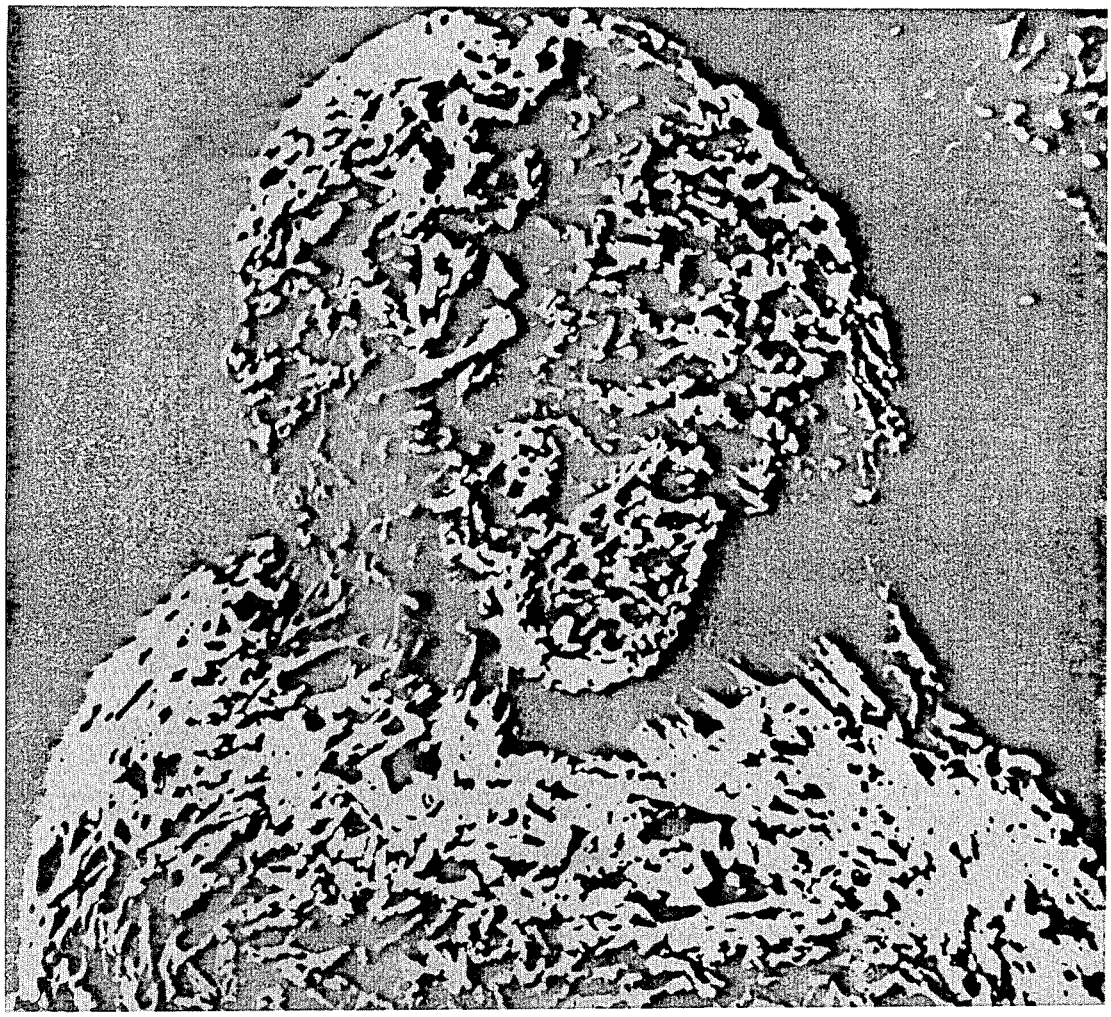
FIG. 6 is a photomicrograph of a major part of a spray dired builder bead or particle prior to post spraying of synthetic organic detergent onto it (to make a free flowing built detergent), magnified 200 times.
Figure 7:
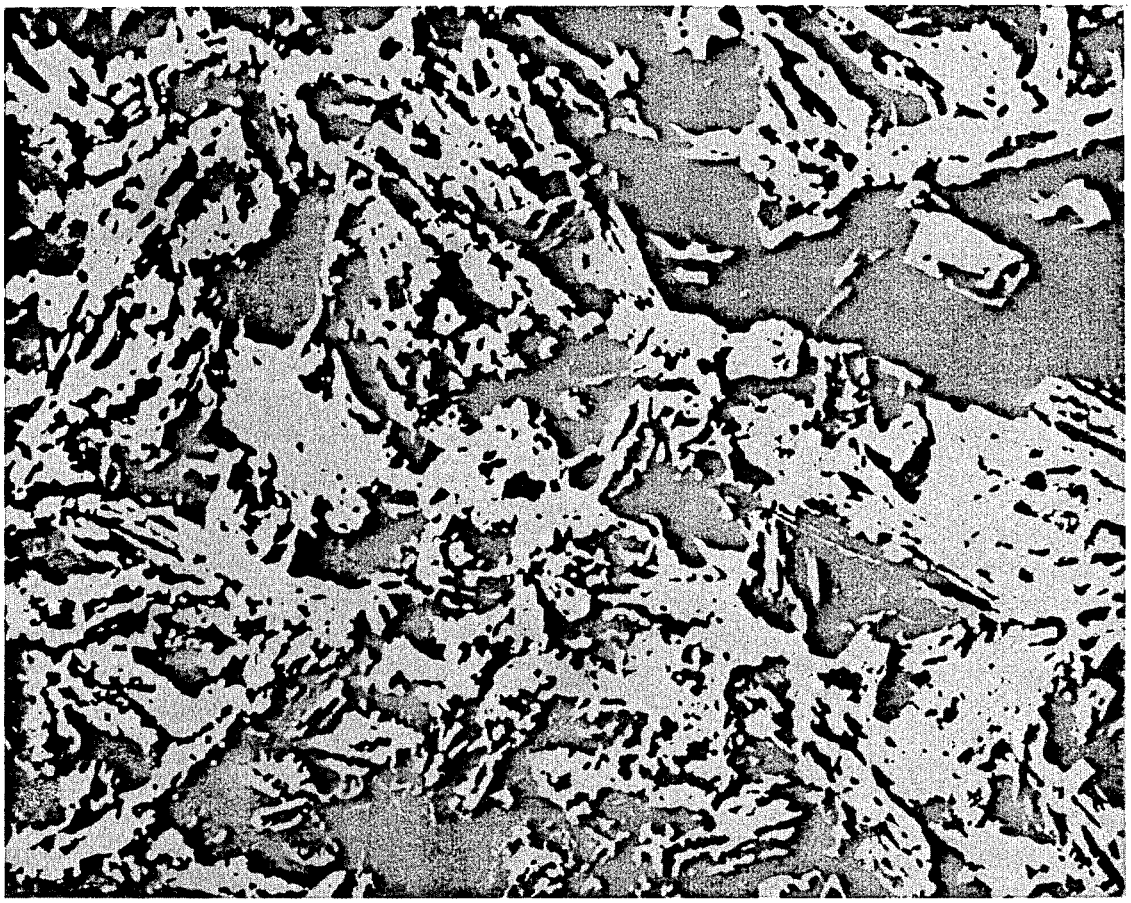
FIG. 7 shows a cutaway portion of the bead of FIG. 6, magnified 2,000 times.

In FIG'S. 1–4 the bottle is shown uncapped but for normal sealing and shipping an internally threaded screw cap 27, shown in FIG. 5, will be screwed in place on threaded neck 17. Normally the cap material on the bottle will be sufficiently resilient so that sealing washers will not be employed (a sealing bead may often suffice) but such washers may be used when desired. Of course, cap 27 of FIG. 5 may also be considered as being in place on the threaded necks of the bottles of FIG'S. 1-4 and therefore additional views showing such positioning will not be given.

FIG'S. 6 and 7 are self-explanatory, the light areas being reflections from the skeletal portions of the bead, both the internal and external parts of which help to strengthen it, and the dark areas showing voids in the bead and at and just below the surfaces thereof, into which liquid or dissolved synthetic organic detergent may be drawn after it is sprayed onto or otherwise brought into contact with the builder beads, producing a bead surface essentially free of detergent, e.g., having detergent covering less than 10% of the external bead surface. The particular bead illustrated in FIG'S. 6 and 7 is one obtained by the spray drying of a crutcher mix containing about 18.8 parts of pentasodium tripolyphosphate hexahydrate, 7.6 parts of sodium silicate ($Na_2O$:-$SiO_2$=2.4), 28.3 parts of pentasodium tripolyphosphate (anhydrous) and 49.6 parts of water, spray dried to a moisture content of about 10%.

Figure 8:
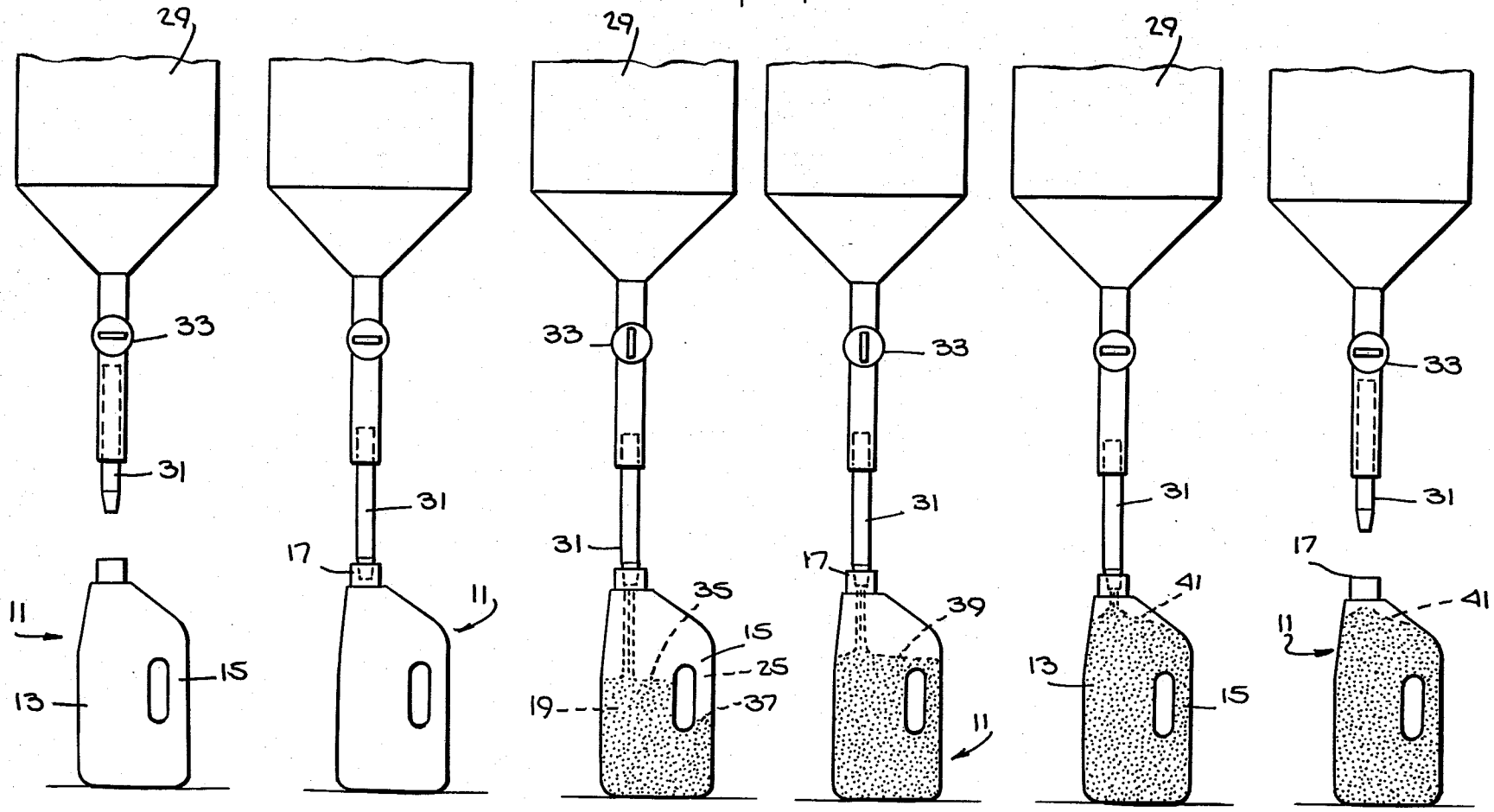
FIG. 8 is a partially schematic elevational view of filling means for filling the bottle with free flowing particulate detergent composition, showing sequences of filling operations and stages.

In FIG. 8 there are shown six steps or stages in the filling of bottle 11 with particulate built detergent 19. In the first of these, at the left of the figure, filling head 2 having an extensible filling nozzle 31 equipped with control valve 33, is positioned above empty bottle 11, of the same structure as is illustrated in FIG'S. 1-4. In the adjacent portion of the figure, illustrating the next stage of the filling operation, extensible nozzle 31 has been lowered into position so that the bottom thereof is inside the neck 17 of bottle 11 but flow of particulate heavy duty detergent to the bottle has not yet commenced. The next step illustrates the filling of particulate detergent 19 into bottle 11 so that the level of the detergent particles is above the mid-point of the height of the handle hand opening in the main volume of the bottle, as shown by level 35, while being at lesser height 37 in passageway 25 of handle portion 15 of the bottle. In the fourth stage shown in the figure the particulate detergent height has been increased further, so that it is above the upper portion of passageway 25 and particulate detergent 19 fills such passageway and forms a level surface 39 above it at about the same height as the particles in the main volume of the bottle. In the fifth stage particles 19 have been filled to the final filling height 41 and in the sixth stage nozzle 31 has been withdrawn. At a subsequent stage in the filling and sealing operation, not shown, the bottle is automatically (preferably) or manually capped.

The bottle utilized as the container for the present product, through which the particulate heavy duty detergent is readily pourable, may be of any suitable material of construction although synthetic organic polymeric plastic materials, such as polyvinyl chloride, polymethyl methacrylate, polyethylene terephthalate, polyethylene, polypropylene, polystyrene, polyesters and polyethers, preferably fiberglass reinforced and nylons are preferred. Glass bottles may also be used. Preferably, the bottles employed are transparent but it is within the invention to employ opaque and translucent plastics, too. An important advantage of the bottle materials mentioned is that they are essentially or completely moisture proof and usually are barriers to the transmission of organic volatile substances too, such as perfumes, even with comparatively thin walls, i.e., about 1 to 3 mm. thick.

The bottles may be of various shapes but, as distinguished from jars and other containers, they include a neck portion which is relatively narrow and has a small opening or passage therein, compared to the average cross-sectional area of the bottle volume. Generally such cross-sectional area will be less than 40% of the average bottle cross-section, preferably less than 30% thereof and more preferably, less than 25% thereof. To facilitate ready pouring and good control of dispensing the neck passageway is of a cross-sectional area in the range of 2 to 40 sq. cm., preferably 3 to 20 sq. cm. and more preferably 5 to 15 sq. cm. The neck will usually be oriented so that its passageway and walls are parallel to the vertical axis of the bottle but may be inclined too, usually no more than 30° from the vertical but greater inclinations are also operative. The neck size will depend on the bottle volume, to an extent, and on the cap size desired for dispensing the detergent composition, about which more will be said later. For 1 quart or 1 liter size bottles neck heights of 1 to 5 cm. can be used but normally such will be from 1.5 to 3 cm. For larger sizes, such as ½ gallon, 2 liters, gallon and 4 liter bottles the necks will be 1 to 5 cm. high too, preferably 2 to 5 cm. Other bottle dimensions will be adjusted according to the bottle volume, when the bottle is of the structure illustrated or of a modified structure.

Various structures and cross-sectional shapes may be employed for the bottle but the most preferred cross-section is one which is substantially oval and the bottles illustrated in the drawing are considered to be in such category. Sometimes it is desirable to square off the rounded minor curves of such oval and such squared off shapes are also considered to be oval and within the meaning of that word, as it is employed in this specification. Instead of oval cross-sections, other curved shapes may be employed, such as circular, elliptical (considered within the meaning of the word oval), regular polygonal, e.g., rectangular, square, and polygonal with rounded corners. The use of all such shapes is within the broadest aspect of this invention.

Although not an essential feature of some embodiments within broader aspects of the present invention, a very important feature of the bottle, with which the present detergent composition is "compatible", is an integral hollow handle, often blow molded or otherwise suitably molded integrally with the neck and main body portions of the bottle. The interior of the handle communicates with other interior portions of the bottle so that the particulate detergent may be filled into said handle and may flow from it. The handle will normally be located at a side of the bottle away from the neck or pouring spout and frequently will not project beyond the normal bottle wall. In other words, rather than the handle being an appendage on the bottle it and the opening thereof will be formed by "removal" of material within the bottle's general outline or silhouette. The handle does not have to be of regular cross-section or interior passageway area but a substantially regular or uniform passageway is preferred. Said hollow handle will have at least a portion thereof with an internal cross-sectional area in the range of 1 to 10 sq. cm., preferably 2 to 5 sq. cm. Normally the handle will be of a convenient length so as to be readily grasped, which length has been determined to be about 8 to 12 cm., preferably 9 to 11 cm. Such a height of hollow handle section will be readily filled by the present flowable, high bulk density, dust-free particulate detergent and such detergent will flow from it easily as it is dispensed. In this respect, it is desirable to have a free height, above the top of the handle passage, between the desired fill level of the detergent particles and the handle passage top, of at least 1 cm. and preferably at least 5 cm., with heights up to 10 or 15 cm. being useful with larger containers. The slope of wall 16 is greater than or about the same as the normal angle of repose of the particulate detergent after depositing during filling or after dispensing and accordingly, facilitates filling of the handle passage and discharge therefrom.

The particulate detergent inside the bottle is one which is of improved flowability, increased bulk density and such particle size distribution as to promote flow and venting of gas, thereby minimizing the tendency to bridge in the container or in restricted portions thereof. The detergent composition of the particles comprises a synthetic organic detergent and a builder for such detergent and of course, may include various adjuvant materials normally present and desirable in detergent compositions and not of such properties as to make the composition inoperative for the present purposes.

The synthetic organic detergent may be any suitable surface active agent of the anionic, nonionic, cationic, ampholytic or amphoteric types but of these the anionic and nonionic materials are highly preferred, with the nonionics being most suited for the present compositions. Usually, cationic detergents will be omitted from the present products and this is especially so when anionics are being employed. Although nonionic detergents are preferred, mixtures of nonionic and anionic detergents are sometimes even more preferred.

The nonionic detergents can be liquid or semi-solid at room temperature and usually will be liquid or tacky at some temperature below 40° C. Preferably the nonionic detergents include but are not limited to ethoxylated aliphatic alcohols having straight or branched chains (preferably straight chained) of from about 8 to 22 carbon atoms with about 5 to 30 ethylene oxide units per molecule. Particularly suitable nonionic organic detergents of such type are manufactured by Shell Chemical Company and are marketed under the trademark Neodol®. Of the various Neodols available Neodol 25–7 (12–15 carbon atom chain higher fatty alcohol condensed with an average of 7 ethylene oxide units) and Neodol 45–11 (14–15 carbon atom chain higher fatty alcohol condensed with an average of 11 ethylene oxide units) are particularly preferred. Another suitable class of ethoxylated aliphatic alcohol detergents is made by Continental Oil Company under the trademark Alfonic® and of the Alfonics the most preferred is Alfonic 1618-65, which is a mixture of 16 to 18 carbon atom primary alcohols ethoxylated so as to contain 65 mol percent of ethylene oxide.

Additional examples of nonionic synthetic organic detergents include those marketed by BASF Wyandotte under the trademark Pluronic®. Such compounds are made by the condensation of ethylene oxide with a hydrophobic base formed by condensing propylene oxide with propylene glycol. The hydrophobic portion of the molecule has a molecular weight of from about 1,500 to about 1,800 and the addition of polyoxyethylene (or ethylene oxide) to such portion increases the water solubility of the molecule as a whole, with the detergent remaining liquid at room temperature up to the point where the polyoxyethylene content is about 50% of the total weight of the condensation product, at which it becomes solid. Also useful nonionic detergents are the polyethylene oxide condensates of alkyl phenols, such as the condensation products of such compounds wherein the alkyl group contains from about 6 to 12 carbon atoms, in either a straight chain or branched chain configuration, with 5 to 25 mols of ethylene oxide per mol of alkyl phenol. The alkyl substituents in such compounds may be derived from polymerized propylene or may be diisobutylene, octene or nonene, for example.

Typical anionic detergents include the higher fatty acid soaps, derived from natural or synthetic higher fatty acids of 8 to 20 carbon atoms or from their triglycerides, e.g., coconut oil, tallow, hydrogenated coconut oil, hydrogenated tallow and mixtures thereof; linear higher alkyl benzene sulfonates wherein the alkyl group is of 10 to 18 carbon atoms, preferably 12 to 15 carbon atoms, e.g., sodium linear tridecyl benzene sulfonate; paraffin sulfonates; olefin sulfonates; and other organic sulfonates and sulfates, in which a lipophilic group is present which normally includes a chain of 10 to 18 carbon atoms. The various nonionic compounds described may be converted to anionic compounds by sulfation of sulfonation, usually by the former operation, at terminal hydroxyls but in such cases normally the proportion of ethylene oxide employed to make the initial nonionic condensate product will be diminished, so that from 3 to 12 mols, preferably 5 to 10 mols of ethylene oxide will be present per mol of anionic detergent.

The various anionic detergents mentioned above are preferably employed as their sodium salts although potassium salts and in some instances small proportions of ammonium or triethanolamine salts may also be utilized.

Representative cationic detergents usually also possess fabric softening and antibacterial properties and these are especially characteristic of quaternary compounds. Examples of such materials are distearyl dimethyl ammonium chloride and 2-heptadecyl-1-methyl-1-[(2-stearoylamido)ethyl]-imidazolinium methyl sulfate. Various amphoteric detergents are also available and these are generally higher fatty carboxylates, phosphates, sulfates or sulfonates which contain a cationic substituent such as an amino group which is quaternized, for example, with lower alkyl groups or may have the chain thereof extended at the amino group by condensation with a lower alkylene oxide, e.g., ethylene oxide. Representative commercial water soluble amphoteric organic detergents include Deriphat® 151, which is sodium N-coco-beta-aminopropionate (manufactured by General Mills, Inc.) and Miranol® C2M (anhydrous acid), made by Miranol Chemical Company, Inc.

Further descriptions of various suitable detergents, including descriptions of classes of detergents to which those mentioned above belong, are found in McCutcheon's Detergents and Emulsifiers, 1973 Annual and in Surface Active Agents, Vol. II, by Schwartz, Perry and Berch (Interscience Publishers, 1958), the descriptions of which are incorporated herein by reference.

The builder of the present compositions is very preferably an inorganic material and of these the water soluble salts are highly preferred, particularly the phosphates. However, organic builders such as sodium citrate, sodium gluconate, trisodium nitrilotriacetate and other organic compounds known to have builder activity and which are capable of being made into a free-flowing built detergent product may also be employed, often in mixture with inorganic materials. Usually the organic compounds will be present as the sodium or other alkali metal salts but sometimes the free acid forms may be used. Although the phosphates are highly preferred for the making of exceptionally free flowing, high bulk density particulate materials containing large quantities of synthetic organic detergent, preferably postadded to said phosphate base beads, other inorganic materials may also be employed as builders (or in combination with them) such as silicates, borates, carbonates, and bicarbonates. Ion-exchanging clays, which act as builders in detergent compositions, removing hardness ions from the wash water, such as type A (preferably 4A) molecular sieves and other suitable molecular sieves may be used as builders, preferably with a suitable phosphate, but for non-phosphate detergents may be employed with other non-phosphate builder salts, alone or with other ion-exchanging zeolites.

With respect to the phosphates utilized and the other inorganic water soluble builder salts, normally the sodium salts will be employed but potassium salts will also be useful. Specific examples of phosphate builder salts include pentasodium tripolyphosphate, other sodium tripolyphosphates, including trisodium tripolyphosphate, trisodium phosphate, disodium phosphate, monosodium phosphate, tetrasodium pyrophosphate and disodium pyrophosphate. The corresponding potassium salts may also be employed but are preferably used in mixture with the sodium salts.

Preferred supplemental builder materials, which also have anti-corrosion properties in the described detergent composition and help to form desirable beads when builder beads are manufactured for subsequent overspraying or postspraying onto them of synthetic organic detergent liquid, are the alkali metal silicates, usually supplied in the form of aqueous solutions containing about 40 to 60% by weight, typically about 50% by weight, of silicate solids. Such silicates are preferably sodium silicates and the $Na_2O:SiO_2$ ratio thereof will normally be from 1:1.6 to about 1:3.4, preferably 1:2 to 1:3 and most preferably about 1:2.35 or 1:2.4.

With the detergent composition, in addition to the synthetic organic detergent and the builder components, various adjuvants may be present, usually preferably incorporated in the structures of the particles either by spray drying them with the particles from a common crutcher mix, or, when they are heat sensitive, by post-adding them. Among such adjuvants are conventional functional and aesthetic materials such as bleaches, e.g., sodium perborate; colorants, e.g., pigments, dyes and optical brighteners; perfumes; foam stabilizers, e.g., alkanolamides, such as lauric myristic diethanolamide; enzymes, e.g., proteases, amylases; skin protecting and conditioning agents, e.g., water soluble proteins of low molecular weight obtained by hydrolysis of proteinaceous materials such as animal hair, hides, gelatin, collagen; foam destroyers, e.g., silicones; fabric softeners, e.g., ethoxylated lanolins; bactericides, e.g., hexachlorophene; buffering agents, e.g., alkali metal acetates and bisulfates; and flow improving agents, e.g., ground clays. Additionally, filler salts such as sodium sulfate, usually anhydrous, and sodium chloride may be present but are usually best avoided.

The built detergent compositiion particles of the present invention will normally contain about 50 to 98% of builder and the balance of synthetic organic detergent, neglecting the presence of any other materials, including water. Considering the presences of other materials in the product, it will usually contain from 30 to 80% of builder, 2 to 35% or 40% of synthetic organic detergent, 0 to 20% of adjuvants, excluding fillers, 0 to 50% of fillers (preferably omitted) and 3 to 15% of moisture. The particulate detergent may be made of such formula by any suitable means, including spray drying the entire formula of heat stable substances, but to obtain best flowability, least dust, highest bulk density and least undesirable chemical reactions and decompositions of components it is preferred to manufacture a base bead comprising substantially only builder with (preferably) or without water and to post-add detergent to it, such as a liquid nonionic detergent or a mixture of anionic and nonionic detergents allthough anionic detergent may sometimes preferably be spray dried with the builder). Usually when the detergent particles are made by such preferred methods about 60 to about 98% of the base heads are of detergent builder having porous outer surfaces and skeletal internal structures and from about 2 to about 40% by weight is of a synthetic organic detergent material, such as one which is liquid or tacky at a temperature below 40° C. and which is disposed internally within said beads so that the outer surfaces of the beads are substantially free of said detergent and therefore are free flowing. In preferred embodiments of the invention the particulate detergent composition comprises 70 to 95% of base beads and 5 to 30% of synthetic organic detergent and the base beads comprise from about 45 to about 85% of a phosphate builder salt, from about 5 to about 15% of alkali metal silicate and from about 5 to about 15% of water. In highly preferred embodiments of the invention the synthetic organic detergent is a nonionic polyethoxylated detergent, such as one derived from aliphatic alcohol having from about 8 to about 22 carbon atoms in a chain therein, condensed with from about 5 to about 30 mols of ethylene oxide per mol. The phosphate salt is preferably a mixture of hydrated and anhydrous salts, with the weight ratio of hydrated phosphate, usually pentasodium tripolyphosphate hexahydrate, to anhydrous phosphate, usually pentasodium tripolyphosphate, anhydrous, being in the range of about 0.3 to about 0.7, preferably 0.4 to 0.6. No matter how the particulate detergent is made it has been found that to produce the bottled product of this invention it is important that the final detergent product be of particle sizes such that at least 90% thereof passes through an 8 mesh screen and is retained on a 200 mesh screen (U.S. Sieve Series) and that the particles are of a bulk density of at least 0.5 g./cc. and a flowability of at least 70% of that of clean dry sand. Preferably at least 90% of the detergent composition passes through a 20 mesh screen and is retained on a 200 mesh screen and more preferably over 95% of it is in the range of 40 mesh to 200 mesh, with less than 0.5% passing through a 200 mesh sieve. The bulk density is preferably in the range of 0.55 to 0.8 g/cc. and the flowability is preferably at least 75% of that of clean dry sand and may approach or equal 100%.

As would be understood by one skilled in the art, the term percent flowability referes to the comparative flow ratio of equal volumes of experimental material and a control material, with both passing through the same size orifice or other flow restricting passageway.

Although predetermined volumes of test and control materials may be passed through any predetermined sized restriction passageway, the following described procedure was used in arriving at the present flowability of the present detergents. A two-quart jar equipped with a cap having about a one-inch diameter circular hole therein, was filled with the detergent particles to be tested, and inverted. The time for gravity flow of the contents out of the jar was measured. Subsequentially, the same test was repeated using clean dry sand. The percent flowability of the particular detergent, compared to that of the sand, was calculated by dividing the time required to empty the jar of sand by the time required to empty the jar of the detergent and multiplying this value by one hundred percent.

Although any free-flowing material, such as sand may be used as a control material. The present percent flowability figures were obtained using sand which was capable of passing through a 20 on 60 mesh screen (U.S. Sieve) subsequent to it being dried in an oven for approximately two hours at 100° C. and cooled just prior to screening.

The particles of the present invention will usually be dust free so that even after shaking in a transparent container, in a time as short as 1 or 2 seconds after cessation of shaking the volume above the product will be clear and no product will adhere to the inner walls of the container. In part, such desirable non-dusting properties are attributable to the content of nonionic detergent, which is usually present in sufficient proportion to lay such dust and to prevent its being created by movement of the particles. Thus, often the amount of nonionic detergent used may be from 12 to 40% of the product and sometimes the proportion employed will be as much as 20 or 25 to 40% of the final product, which can be sorbed into the interiors of the described detergent particles without making the surfaces sticky or poorly flowing. Representative of especially preferred nonionic detergents employed is the condensation product of an aliphatic alcohol having a carbon chain of 10 to 18 carbon atoms, with 6 to 14 mols of ethylene oxide per mol of product and in such case, especially when 20 to 40% is present in the detergent composition, the percentage of particulate detergent passing a 200 or 325 mesh sieve is often nil. Of course, the presence of more sorbable detergent in the particulate product and the accompanying high bulk density product resulting makes it possible to use a lesser volume of product per wash load, thereby making packaging in bottles more feasible and increasing the practicability of dispensing smaller quantities of detergent and measuring them in the bottle cap.

In those circumstances where dusting is noted, even very small amounts thereof, it may be desirable to coat the interior of the bottle with a thin layer of silicone or quaternary ammonium salt, such as those previously described, or both, to smoothe the interior bottle surface and to promote diffusion of any electrostatic charge on the bottle interior and thereby obviate adhesion of the fine particles to the bottle interior. Normally the amounts of such materials employed will be sufficient to form a thin layer on the bottle interior, often only 1 to 10 molecules thick.

The cap for the bottle may be of any suitable structure and material but screw caps are preferred because of their ready availability, trouble-free sealing and measuring capabilities. However, because the contained product is a particulate solid rather than a liquid, completely tight sealing is not always necessary and other types of caps may be employed which do not have the sealing capabilities of the normal screw caps. For example, caps that are press fitted into place may be used, as may be those which include a slide valve mechanism to open a dispensing passage. In such and other cases the neck portion may be made flatter than for the screw caps and may be reduced to an opening in a bottle wall. The material of construction of the cap may be any suitable material, including synthetic organic polymeric plastics, rubber, especially hard rubbers, metals and metal alloys. Among the useful synthetic orgaic polymers may be mentioned melamine formaldehydes, phenol formaldehydes, nylons, polystyrenes, (dense or from foamed beads) fiberglass-reinforced polyesters, polypropylene and polyethylene.

The preferred internally screw threaded caps form a tight seal with the neck of the bottle when screwed into place, preventing loss of contents and preventing access of moisture or other external contaminants to the contents or transmission of moisture vapor from the bottle. Thus, because of the screw type structure and the barrier qualities of the bottle, an effective and inexpensive seal is obtained without the need for employment of special barrier liners or coatings on penetrable containers normally used for the packing of detergent powders. Additionally, although the cap is relatively small it may be used for measuring out desired quantities of the present detergent particles. However, as a practical matter the screw caps of such size as to be useful for sealing off the openings in bottles of useful size, e.g., one quart to one gallon (although one pint bottles may also be used), would not be large enough to hold in one capful or even in four capfuls the volume of ordinary detergent particles that would have to be charged to an automatic washing machine for one wash. Thus, with conventional spray dried detergent powders of a bulk density of about 0.3 g./cc., onto which a small proportion of nonionic detergent component has been post-sprayed, about 90 grams or 300 cc. of detergent particles would have to be charged to a 17 gal. washing machine tub and the normal bottle cap has a volume of only 5 to 15 cc. Thus, even with a volume of 15 cc. one would have to measure out twenty capsful of such a low density "normal" powdered detergent and this would not be acceptable to the homemaker nor would there be any advantage in following such a procedure rather than utilizing an ordinary measuring cup. However, by the method of the present invention, utilizing the package thereof with only a slightly larger cap, such measurement is feasible. With the larger quantity of detergent, such as a liquid nonionic detergent, that may be incorporated in the present beads it is possible to cut in half the required amount of detergent product needed per wash load and with beads of greater bulk density, e.g., 0.6, another halving of the volume needed is obtained. Thus, by merely making the cap slightly larger, so as to give it a volume of about 20 cc. instead of 15 cc., measuring out of four capsful of detergent powder will provide enough for one ordinary wash in a top loading machine and for side loading machines, where conventionally one uses about half as much detergent, measuring two capsful will be sufficient. By further adjusting the bulk density of the product, the synthetic organic detergent content thereof and the cap size, one may make it possible to use as little as one cap of detergent per wash or as much as three capsful. Thus, the present invention provides a convenient means for readily measuring a quantity of particulate detergent in a bottle cap of said bottled particulate detergent to provide the desired quantity of detergent composition for an ordinary wash.

Methods for the manufacture of free flowing high bulk density particulate detergents of the desired particle sizes are known in the art and may be used according to the invention. Thus, controlled spray drying, spray cooling, agglomeration, solidification, abrading crystalline materials, etc., have been described and are useful. The nonionic detergent may be incorporated into base particles or may be integrally formed with the particles so long as the particles are of desired sufficiently round or rounded structure to be free flowing and have any liquid or tacky detergent material internally held within the interstices in the particle and not on the surface thereof (normally less than 20% will be on the surface and preferably less than 10%). After manufacture of the detergent particles they are filled into the bottles and the bottles are capped by a method like that or equivalent to that illustrated in FIG. 8 but other more complicated and less satisfactory filling techniques may also be utilized. After sealing in the bottle the shelf life of the product is almost limitless, as a practical matter in most cases being at least three years without any undesirable changes.

The invented product possesses a multitude of advantages, many of which have already been mentioned. A comparatively inexpensive and readily obtainable container with a built in hollow handle may be employed with conventional sealing means that results in the product having excellent storage properties. The particles are attractively rounded and of uniform shape and flow like a liquid. They are heavy enough so as to be measurable in a comparatively small cap and so as to have a multiplicity of washing quantities containable in a reasonably sized bottle, about 10 to 20 washes per quart, normally about 12. Commercial liquid detergents yield only about 8 washes per quart (such figures being for top loading washing machines). Additionally the cap can be graduated for finer measurings. The product is easily manufactured and allows the convenient incorporation of normally heat-unstable components therein. Also, on storage, due to the fact that it is not in a liquid phase, stability is promoted. This allows the use in the formulation of certain normally less stable and more effective detersive ingredients.

The following examples illustrate but do not limit the invention. Unless otherwise mentioned, in this specification all parts are by weight and all temperatures are in °C.

EXAMPLE 1

An aqueous slurry is prepared consisting of 14.5 parts of pentasodium tripolyphosphate powder (anhydrous), 15.2 parts of 50% aqueous solution of sodium silicate ($Na_2O:SiO_2=1:2.4$) and 21 parts of deionized water. The slurry is brought to a temperature of about 60° C. and is mixed well in a crutcher to form the hexahydrate salt of pentasodium tripolyphosphate. The preliminary crutcher mix thus made is then heated to 88° C. and is maintained between that temperature and 93° C. to prevent hydration of the anhydrous sodium tripolyphosphate powder to be added subsequently. The full crutcher mix is then made by addition, at a temperature in the mentioned 88° to 93° C. range, of 28.3 parts of pentasodium tripolyphosphate powder (anhydrous) and 21 parts of deionized water. The mix resulting contains from about 45 to about 50% of solids by weight, due to hydration of some of the anhydrous tripolyphosphate and evaporation of some moisture.

The crutcher mix is pumped to a countercurrent spray drying tower, which is 8 ft. high, and is sprayed at a manifold temperature of 82° C. and at a pressure of about 750 lbs./sq. in. gauge (54 kg./sq. cm., absolute) through a Whirljet 15-1 spray nozzle into drying air having an initial temperature, as it enters the spray tower, of about 315° C.

The spray dried base beads produced are of internal structure and outer surface characteristics like those of the bead shown in FIG'S. 6 and 7, being rounded solid particles of irregular configuration having sponge-like porous outer surfaces and skeletal internal structures, in contrast to conventional spray dried detergent beads which have a substantially continuous outer surface and a hollow core therein.

The spray dried base beads contain 77% of sodium tripolyphosphate, 13% of sodium silicate and 10% of moisture. The bulk density is 0.55 g./cc., the flowability is 86% of that of dry sand and the product is completely non-tacky. A sieve analysis shows: 1% on a No. 20 U.S. Series sieve; 19% through No. 20, on No. 40; 50% through No. 40, on No. 60; 20% through No. 60, on No. 80; 6% through No. 80, on No. 100; 3% through No. 100, on No. 200; and 1% through No. 200.

The base beads are introduced into a batch rotary drum blender and are post sprayed at 49° C. with Neodol 25-7 and minor proportions of coloring agent, perfume and brighteners to produce a final product consisting of 78% of the base bead, 19.7% of Neodol 25-7 and 2.3% of the minor components. In other experiments the liquids (the Neodol 25-7 and the minor components or aqueous solutions or dispersions of them) are sprayed in the forms of fine droplets or mists onto the tumbling base beads in Patterson-Kelly twin shell and Zig-Zag blenders.

The products resulting are of a bulk density of 0.68 g./cc. and a flowability of 79% and are completely non-tacky. They analyze: 1% on a No. 20 U.S. sieve, 20% on No. 40: 52% on No. 60; 20% on No. 80; 5% on No. 100; 2% on No. 200; and 0% through No. 200.

The finished product, obtained after only ten minutes of mixing, is filled at room temperature into bottles of the type illustrated in FIG'S. 1–4 in the manner shown in FIG. 8. The bottles are clear polyvinyl chloride bottles and hold a volume of ½ gallon (approximately two liters). They are gravity filled with product without incident, with the average filling time being about five seconds per bottle or less and with the hollow handle being filled too, without any problems being encountered. After filling, the bottles are appropriately mechanically capped and the products made are packed in cases and sent to storage. Based on past experience with storage of heavy duty detergents and tests run thereon it is considered that the products made have a storage stability in excess of three years.

Sufficient product to result in a concentration of 0.075% in a 17 gallon wash tub is obtained in 75 cc. of detergent, which is measurable by a cap approximately 5 cm. in diameter and 4 cm. high or by two capsful 4 cm. in diameter and 3 cm. high. The former cap size is employed with the bottle illustrated and described herein.

When the detergent is used in a top loading washing machine of 17 gallons tub capacity to wash an ordinary load of laundry (approximately 9 pounds) good washing is obtained. Similarly, when half as much is used with a front loading washing machine the laundry is effectively cleaned. During use it is noted that the product flows freely out of the bottle and out of the handle hollow, does not spill easily, as in the case of liquids, and does not lead undesirable gel or cement-like coatings on the bottle cap or threads.

The product made is attractive and lends itself to identification coloring of some or all of the particles therein by known means, e.g., post-spraying some particles with dye.

Instead of making the detergent composition particles according to the foregoing described method products of the same bulk density, particle size and flowability, which are also non-tacky, are made by spray cooling, agglomeration and abrasion techniques, known in the art for manufacturing particulate detergent, and useful bottled particulate detergents result having the desirable detergency properties mentioned. However, those made by the method described earlier in this example are considered to be superior to the products made by such other techniques, usually being more attractive, freer flowing and of greater bulk density for products of similar compositions, and having the recited sponge-like porous outer surface and skeletal internal structures.

EXAMPLE 2

A product like that of Example 1 is made by essentially the same method, utilizing a crutcher pre-mix of 25 parts of hot water (60° C.), 3.5 parts of sodium silicate solids and 13 parts of pentasodium tripolyphosphate powder (anhydrous) and mixing the slurry well in a steam jacketed vessel to hydrate the phosphate to the hexahydrate and then heating it to 93° C. with steam, at which temperature there is subsequently added to the crutcher mix 13 parts of the anhydrous tripolyphosphate, 25 parts of water, 13 more parts of anhydrous tripolyphosphate and 7.5 parts of anhydrous sodium carbonate. During the mixing the temperature is not allowed to fall below 82° C. to prevent hydration of the subsequently added anhydrous tripolyphosphate. The mix is sprayed at a pressure of 800 lbs./sq. in. gauge (57 kg./sq. cm. absolute) into a spray tower having an inlet drying air temperature of 343° C. and an outlet air temperature of about 113° C. The builder particles made are of a particle size distribution such that 90% by weight passes through a No. 20 screen (U.S. Sieve Series) and 90% by weight is retained on a No. 200 screen. 78 Parts of the spray dried beads are then oversprayed by the method described in Example 1 with 19.5 parts of Neodol 25-7 and 2.5 parts of minor ingredients (optical brighteners and perfume) as they are tumbled in an inclined cylindrical tumbling device for about five minutes. The product removed has a bulk density of about 0.75 g./cc., a flowability rating of 75% and a moisture content of about 5%. It is filled into the described bottles by the method of Examples 1 and is tested for suitability as a heavy duty detergent by the method described therein. It is found to be very satisfactory, having the desirable properties previously reported for the other Example 1 product which was made by a similar method.

EXAMPLE 3

The procedures of Examples 1 and 2 are followed in making a base bead from: 13 parts of sodium tripolyphosphate hexahydrate; 26 parts of sodium tripolyphosphate, anhydrous: 47 parts of deionized water; 7.5 parts of organic builder "M" (Monsanto Chemical Company); and 6.5 parts of sodium silicate solids ($Na_2O$:$SiO_2$=1:2.4). 85 Parts of the spray dried builder beads resulting are oversprayed with Neodol 45-11 (12 parts) and minor ingredients (3 parts of a total of fluorescent brighteners and perfume). The resulting detergent passes the tests mentioned in Examples 1 and 2 and is a free flowing, dust-free, attractive, high bulk density laundry detergent of good detergency.

EXAMPLE 4

The experiment of Example 1 is repeated using Alfonic 1618-65 as the nonionic detergent to provide a final granular detergent product having a nonionic detergent content of 30%, with the proportions of other components being reduced correspondingly. The product obtained is an excellent detergent and the corresponding bottled particulate detergent is of excellent stability and use characteristics, as previously mentioned.

EXAMPLE 5

The experiments of Examples 1–4 supra are repeated with different bottles and caps and with different particulate detergent contents in them, as described previously, varying the proportions of the composition components ±10%, ±20% and ±30% and maintaining them within the proportions and ratios given in the specification and filling them into different bottles and caps of different materials and structures, within the limits so given. Such products are readily made, free flowing, of high bulk density and readily measurable by the caps employed, and the detergents contained are attractive and useful. Detergents and similar products made by other manufacturing techniques, such as those described, which result in the same detergent particle characteristics, are similarly satisfactory.

The present invention is of a new commercial detergent product, a bottled particulate heavy duty detergent. It avoids problems associated with the use of liquids and for the first time allows the commercially acceptable use of particulate heavy duty detergent powders in a manner similar to that in which heavy duty liquid detergents have been used, but without the disadvantages of such liquids. The bottles used are moisture proof, promoting storage stability. They are attractive, relatively small, re-sealable, easy to handle and yet, they allow the use of powdered detergents where previously only liquids could be employed, with the disadvantages inherent in liquids. The inventive concept and the realization of that concept in the reduction to practice and production of a commercially viable product with the particular desirable characteristics of the various components of which it is composed represent significant advantages in the heavy duty laundry detergent art.

The invention has been described with respect to illustrations and examples thereof but is not to be limited to these because it is evident that one of skill in the art, with this specification before him, will be able to utilize substitutes and equivalents without departing from the invention.

What is claimed is:

1. A bottled particulate laundry detergent which comprises a transparent bottle having a neck portion for dispensing detergent from the bottle, the bottle being made of a thin-walled synthetic organic polymeric plastic which is essentially moisture proof, the neck being located at the top of the bottle and having a passageway therethrough with a cross-sectional area of less than 40% of the average cross-sectional area of the bottle, wherein said neck passageway has a cross-sectional area of about from 2 to 40 sq. cm., the bottle being provided further with an integral hollow handle located on the side of the bottle, wherein the interior of said handle communicates with other interior portions of the bottle, and said handle has an internal cross-sectional area in the range of about 1 to 10 sq. cm., said neck being located nearer the side of the bottle opposite that of the handle and a free-flowing particulate detergent in said bottle, pourable through said neck and handle, the composition of which comprises from about 2 to 50% by weight of a synthetic organic detergent selected from the group consisting of nonionic detergents and mixtures of said nonionic detergents with anionic detergents, wherein said nonionic detergent is a normally tacky ethoxylated detergent, and from about 50 to 90% by weight of builders for said detergent, wherein said builders are selected from the group consisting of ion exchanging clays, organic builders and sodium salts of at least one of bicarbonates, borates, carbonates, phosphates, and silicates, said particles sized such that at least 90% thereof pass through an 8 mesh screen and are retained on a 200 mesh screen (U.S. Sieve Series), are of a bulk density of at least 0.5 g/cc., are of a flowability sufficiently high so that said particulate detergent flows through the neck and handle of said bottle and are substantially dust-free so that after pouring some of said composition from said bottle the bottle and the contained volume above the level of the particulate detergent return to a transparent condition, and a resealable cap for said neck portion.

2. A method for filling a hollow handled bottle with detergent without special operations to fill the handle, which comprises:

maintaining in a vertical position, a bottle made of a thin-walled synthetic organic polymeric plastic which is essentially moisture proof, said bottle having a neck located at the top, a passageway therethrough with a cross-sectional area of less than 40% of the cross-sectional area of said bottle, said neck passageway having a cross-sectional area of from about 2 to 40 sq. cm., said neck being located nearer the side of the bottle opposite that of the handle, an integral hollow handle located on the side of said bottle wherein the interior or said handle communicates with other interior portions of said bottle, said handle having an internal cross-sectional area in the range of from about 1 to 10 sq. cm.;

directing a free-flowing particulate detergent downwardly through said neck to fill the main volume of said bottle and said handle, the filling of said handle being accomplished without tilting said bottle or directing the detergent into said handle by the flow of the particulate detergent downwardly into said handle from a level of detergent rising above said handle;

said particulate detergent being about 2 to 50% by weight of a synthetic organic detergent selected from the group consisting of nonionic detergents and mixtures of said nonionic detergents with anionic detergents, wherein said nonionic detergent is a normally tacky ethoxylated detergent, and from about 50 to 90% by weight of builders for said detergent, wherein said builders are selected from the group consisting of ion-exchanging clays, organic builders and sodium salts of at least one of bicarbonates, borates, carbonates, phosphates and silicates, said particles sized such that at least 90% thereof pass through an 8 mesh screen and are retained on a 200 mesh screen (U.S. Sieve Series), are of a bulk density of at least 0.5 g/cc., are of a flowability sufficiently high so that detergent flows freely through said neck and handle of said bottle, and are substantially dust-free so that after pouring some of said composition from said bottle, the bottle and the contained volume above the level of the particulate detergent composition return to a transparent condition, and a resealable cap for said neck portion.

3. The method of claim 2 wherein said neck passageway has a cross-sectional area of about from 3 to 20 sq. cm., said synthetic organic detergent includes a normally tacky ethoxylated nonionic detergent in an amount of from about 5 to 30% by weight, said bulk density is about from 0.55 to 0.80 g/cc.

4. The method of claim 3 wherein the flowability of said particulate laundry detergent is greater than 70%.

5. The method according to claim 2 wherein said bottle neck passageway has a cross-sectional area in the range of 3 to 20 sq. cm. and said handle has a cross-sectional area in the range of 2 to 5 sq. cm.

6. The method according to claim 2 wherein the bulk density of said particulate detergent is at least 0.5 g. per cc and the flowability of said detergent is at least 70% that of clean, dry sand.

7. The method according to claim 2 wherein said synthetic organic detergent is at least 12% by weight nonionic detergent.

8. The method according to claim 2, 5 or 6 wherein said synthetic organic detergent is a polyethoxylated aliphatic alcohol or a polyethoxylated alkyl phenol.

9. The method according to claim 2, 6 or 7 wherein the bulk density is at least about 0.6 g. per cc.

10. The method according to claim 2 wherein said neck is adjacent to one side of said bottle and said handle is opposite said neck.

* * * * *

Disclaimer 4,351,740.—*David Joshi,* Piscataway, N.J. and *Richard Klingaman,* Houston, Tex. BOTTLED PARTICULATE DETERGENT. Patent dated Sept. 28, 1982. Disclaimer filed July 25, 1983, by the assignee, *Colgate-Palmolive Co.*

Hereby enters this disclaimer to claim 20 of said patent.

[*Official Gazette September 27, 1983.*]